US010105715B2

(12) United States Patent
Schlarb

(10) Patent No.: US 10,105,715 B2
(45) Date of Patent: Oct. 23, 2018

(54) SOLID-BOWL SCREW CENTRIFUGE HAVING AN ENERGY RECOVERY DEVICE

(71) Applicant: Flottweg SE, Vilsbiburg (DE)

(72) Inventor: Manfred Schlarb, Vilsbiburg (DE)

(73) Assignee: Flottweg SE, Vilsbiburg (DE)

( * ) Notice: Subject to any disclaimer, the term of this patent is extended or adjusted under 35 U.S.C. 154(b) by 764 days.

(21) Appl. No.: 14/415,827

(22) PCT Filed: May 16, 2013

(86) PCT No.: PCT/DE2013/100183

§ 371 (c)(1),
(2) Date: Jan. 20, 2015

(87) PCT Pub. No.: WO2014/015851

PCT Pub. Date: Jan. 30, 2014

(65) Prior Publication Data

US 2015/0165450 A1 Jun. 18, 2015

(30) Foreign Application Priority Data

Jul. 23, 2012 (DE) ..... 10 2012 014 563

(51) Int. Cl.
*B04B 1/20* (2006.01)

(52) U.S. Cl.
CPC ..... *B04B 1/20* (2013.01); *B04B 2001/2075* (2013.01); *B04B 2001/2083* (2013.01)

(58) Field of Classification Search
CPC ..... B04B 1/20; B04B 2011/2083; B04B 2011/2075; B04B 11/00
(Continued)

(56) References Cited

U.S. PATENT DOCUMENTS 4,764,163 A * 8/1988 Caldwell ..... B04B 1/20 494/53
4,978,331 A * 12/1990 Luchetta ..... B04B 1/2016 210/380.3

(Continued)

FOREIGN PATENT DOCUMENTS

| | | | |
|---|---|---|---|
| JP | 2009-136790 | | 6/2009 |
| JP | 2009136790 A | * | 6/2009 |
| WO | 2012-013624 | | 2/2012 |

OTHER PUBLICATIONS

International Search Report dated Oct. 2, 2013.
Written Opinion.

*Primary Examiner* — Walter D. Griffin
*Assistant Examiner* — Shuyi S. Liu
(74) *Attorney, Agent, or Firm* — Gerald E. Hespos; Michael J. Porco; Matthew T. Hespos

(57) ABSTRACT

A solid-bowl screw centrifuge has a centrifuge drum that is rotatable about a longitudinal axis, at least one outlet for discharging clarified material from the centrifuge drum, and an energy recovery device, arranged at the outlet, for recovering energy from the discharged clarified material, when the solid-bowl screw centrifuge is in operation, the centrifuge drum can rotate in a first direction of rotation and in a second direction of rotation opposite to the first direction of rotation. The energy recovery device has a first active surface, via which clarified material can flow out when the centrifuge drum is rotated in the first direction of rotation, and a second active surface, via which clarified material can flow out when the centrifuge drum is rotated in the second direction of rotation.

10 Claims, 2 Drawing Sheets

(58) Field of Classification Search
USPC ..... 494/2, 53, 56
See application file for complete search history.

(56) References Cited

U.S. PATENT DOCUMENTS

| | | | | |
|---|---|---|---|---|
| 5,147,277 | A * | 9/1992 | Shapiro | B04B 1/20 210/374 |
| 7,022,061 | B2 | 4/2006 | Leung et al. | |
| 2004/0072668 | A1 | 4/2004 | Leung | |

* cited by examiner

SOLID-BOWL SCREW CENTRIFUGE HAVING AN ENERGY RECOVERY DEVICE

BACKGROUND

1. Field of the Invention

The invention relates to a solid-bowl screw centrifuge having a centrifuge drum that is rotatable about a longitudinal axis, at least one outlet for discharging clarified material from the centrifuge drum, and an energy recovery device, arranged at the outlet for recovering energy from the clarified material flowing out.

2. Description of the Related Art

As is known, in order to rotate the centrifuge drum of a solid-bowl screw centrifuge, drive energy is necessary because, in order to introduce the material to be clarified or centrifuged, said material has to be given kinetic energy. Conversely, during emptying, the kinetic energy of the clarified material flowing out is converted into friction energy.

Attempts have been known to be made to use the kinetic energy of the material flowing out as far as possible in such a way that this energy contributes again to driving the rotational movement of the centrifuge drum. Known to this end are, inter alia, outlet ducts at outlet openings on the end side of the centrifuge drum, said outlet ducts diverting the stream of material in the tangential direction. The material that is then emerging not in the axial direction but in a tangential direction, supplies the centrifuge drum, on account of its centrifugal energy, with a pulse in the direction of rotation, said pulse driving the centrifuge drum in the direction of rotation. Such outlet ducts are known for example from WO 2012 013624 A1.

The invention is based on the object of creating a solid-bowl screw centrifuge in which the energy recovery is provided in a particularly cost-effective and at the same time particularly efficient manner on account of pulse feedback of the material flowing out.

SUMMARY OF THE INVENTION

According to the invention, this object is achieved with a solid-bowl screw centrifuge which has a centrifuge drum that is rotatable about a longitudinal axis. The centrifuge drum has at least one outlet for discharging clarified material from the centrifuge drum. Arranged at the outlet is an energy recovery device for recovering energy from the clarified material flowing out. When the solid-bowl screw centrifuge is in operation, the centrifuge drum can rotate in a first direction of rotation and in a second direction of rotation opposite to the first direction of rotation. The energy recovery device has a first active surface, via which clarified material can flow out when the centrifuge drum is rotated in the first direction of rotation. At the same time, a second active surface, via which clarified material can flow out when the centrifuge drum is rotated in the second direction of rotation, is formed on the energy recovery device.

According to the invention, an energy recovery device which can be used both during leading operation of a centrifuge drum and during trailing operation is created. In the previously known solid-bowl screw centrifuges, instead of this, for such different directions of rotation of the drum, different energy recovery devices also had to be used. With the solution according to the invention, it is therefore easier and more cost-effective to change between the different modes of operation of a solid-bowl screw centrifuge. Adaptation to the particular operation of the solid-bowl screw centrifuge is achieved easily in that, according to the invention, different active surfaces that are provided on the energy recovery device are used at the latter.

In one advantageous development of the solid-bowl screw centrifuge according to the invention, the two active surfaces are formed with a single shell. A plurality of surface regions which are individually adapted to the particular drainage of clarified material flowing out are then located at the shell of this type. The part-surfaces have in this case in particular a particularly adapted extent, curvature and/or also inclined position with respect to the centrifuge drum. Furthermore, in each case one outflow edge, over which the clarified material flowing out finally leaves the energy recovery device, can be provided on the part-surfaces. In particular, advantageously provision is made of a first and a second outflow edge, which are provided opposite one another at such a shell-like or concave overall outflow surface.

The shell of this type is preferably formed with a radius which is substantially the same as the radius of the material discharged at the outlet. The radius of the clarified material flowing out is also designated the pond surface. This radius is therefore advantageous for the curvature of a concave outflow surface according to the invention because such a radius results in particularly low-loss overflowing out of the centrifuge drum and over the outflow surface. The outflow surface can be positioned precisely upstream of the outlet and be adapted to the particular operating conditions. In this case, adaptation to the particular drum rotation speeds and product throughputs at the centrifuge drum can be carried out in particular in a very advantageous manner.

Alternatively, the shell is formed with a radius which is greater than the radius of the material discharged at the outlet. Such a radius inevitably results in discharged material sliding radially toward the outside. The energy recovery device of this type is therefore less sensitive to adjustment errors that may arise. Advantageously, the shell provided according to the invention is furthermore arranged at least in a somewhat tilted manner with respect to the direction of the tangent to the outlet. Particularly preferably, the angle between the tangent to the outlet with the pond surface thereof and the tangent of the shell positioned thereat is between 5° and 20° counter to the direction of rotation of the centrifuge drum radially toward the outside. An angle of 12° is particularly preferred.

Particularly preferably, in the solid-bowl screw centrifuge according to the invention, the energy recovery device is formed in an area-symmetrical manner. With such an energy recovery device, when the direction of rotation is reversed, said energy recovery device can take up the same, but mirror-inverted position on the centrifuge drum. Such an energy recovery device is accordingly particularly easy to reposition between the modes of operation.

The energy recovery device is furthermore advantageously able to be brought into a first position in which the first active surface is in operation, and able to be brought into a second position in which the second active surface is in operation. These two positions can be set up very easily by changing the screwed position of the energy recovery on the centrifuge drum. Alternatively, a switching means can also be provided such that the energy recovery switches from one direction of rotation to the other direction of rotation in a remote-controlled or automatic manner.

For this reason, the outlet is also preferably formed as an outlet opening in a drum end wall of the centrifuge drum, and the energy recovery device is attachable to the drum end wall, in each case in a stationary manner, in at least two positions that are symmetrical to the radial direction. With this symmetrical position specification, it is particularly easy to change the mounted position of the energy recovery on the drum end wall.

Furthermore, the energy recovery device preferably has a first deflecting surface by way of which clarified material is deflectable from a largely axial direction of movement into a largely tangential direction of movement when the centrifuge drum is rotated in the first direction of rotation. The energy recovery device moreover advantageously has a second deflecting surface by way of which clarified material is deflectable from a largely axial direction of movement into a largely tangential direction of movement when the centrifuge drum is rotated in the second direction of rotation. The deflecting surfaces of this type make a considerable contribution to recovering energy and at the same time make it possible to use the energy recovery device both for leading drum operation and for trailing drum operation.

Such a deflecting surface provided on an energy recovery device is preferably arranged, when the associated centrifuge drum is viewed in longitudinal section, so as to be directed in an inclined manner with respect to the longitudinal axis of the centrifuge drum at least sectionally in an inclined manner radially toward the inside from the outlet. On the deflecting surface that is arranged in such a way, the clarified material, when flowing out of the outlet, is deflected not only from the axial direction into the substantially tangential direction, but at the same time also moves axially along the deflecting surface from radially on the outside to radially on the inside. During this movement from the outside to the inside, the potential energy of the material drops because it moves radially toward the inside with a lower circumferential speed. The material thus releases energy to the energy recovery device, which contributes to accelerating the centrifuge drum. The movement of the material on the deflecting surface which is in an inclined position with respect to the longitudinal axis and which can in this case be planar or curved in the axial direction, is a self-regulating process. The greater the energy release, the further the material moves in the axial direction and in the process from radially on the outside to radially on the inside.

The design, provided in such a way, of a deflecting surface on an energy recovery device represents an independent invention in addition to the abovementioned active surfaces, said independent invention also being advantageous in combination with only one active surface alone. The invention is accordingly also directed at a solid-bowl screw centrifuge which has a centrifuge drum that is rotatable about a longitudinal axis, wherein the centrifuge drum has at least one outlet for discharging clarified material from the centrifuge drum, an energy recovery device for recovering energy from the clarified material flowing out being arranged at said outlet. In this case, the energy recovery device has at least one deflecting surface which is in an inclined position with respect to the longitudinal axis of the centrifuge drum. The angle of the inclined position is advantageously between 5° and 45°, preferably between 10° and 20°, particularly preferably 15°.

Furthermore, in the solid-bowl screw centrifuge according to the invention, the two active surfaces and the two deflecting surfaces are preferably formed with a single shell, corresponding to the abovementioned configuration.

Finally, in the solid-bowl screw centrifuge according to the invention, provision is preferably made of a weir device which is able to be brought into at least two positions together with the energy recovery device, and is formed in particular in one piece with the energy recovery device. The weir device makes it possible that, together with the positioning of the energy recovery device, a weir edge of the weir device is also placed at the same time in a manner coordinated therewith on the centrifuge drum. In particular, a weir edge of the weir device can in this case be arranged in two symmetrical positions, at which the shell formed according to the invention is likewise advantageously placed. In these positions, both the shell and the weir edge are positioned so as to be tilted in the associated radial direction. As a result, at the weir edge, the material flowing out flows out mainly through a triangular region. This triangular region makes it possible for the flow of clarified material to be able to be metered precisely in particular in the case of low throughflow rates through the solid-bowl screw centrifuge. The overflowing of the weir edge furthermore takes place in a region which allows a long flow path over the abovementioned active surface for diversion and drainage in a tangential direction.

An exemplary embodiment of the solution according to the invention is explained in more detail in the following text with reference to the appended schematic drawings.

DETAILED DESCRIPTION

Figure 1:
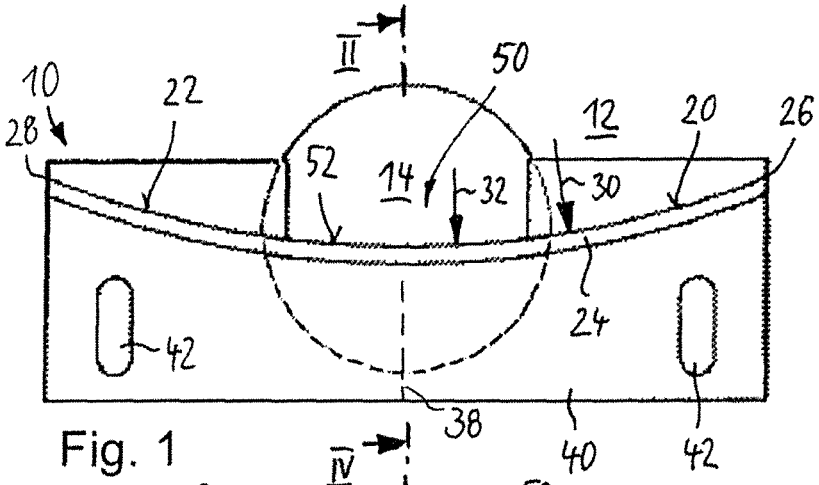
FIG. 1 shows a front view of a first exemplary embodiment of an energy recovery device according to the invention.

The figures illustrate energy recovery devices 10 which are each intended to be arranged on a drum end wall or end wall 12 of a centrifuge drum that is not illustrated further. In this case, a plurality of outlets 14 each in the form of a circular outlet opening are formed in the end wall 12 in a circular manner about the rotation axis of the centrifuge drum. In each case one of these outlets 14 is illustrated in the figures.

The centrifuge drum is rotatable in a first direction of rotation 16 and in a second direction of rotation 18 that is opposite to this first direction of rotation 16. The energy recovery device 10 serves to recover energy from the clarified material flowing out of the outlet 14. The material flowing out there has kinetic energy corresponding to the rotational speed, and largely loses said kinetic energy at the transition into a stationary drain of the associated centrifuge. This kinetic energy can be partially intercepted by the energy recovery device 10 and transmitted back to the centrifuge drum so that less rotation energy has to be applied as a whole for the rotation of the centrifuge drum.

To this end, the energy recovery device 10 comprises a first active surface 20, via which clarified material can flow out when the centrifuge drum is rotated in the first direction of rotation 16. Also formed on the energy recovery device 10 is a second active surface 22, via which clarified material can flow out when the centrifuge drum is rotated in the second direction of rotation 18. The two active surfaces 20 and 22 are both formed with a single shell 24 which projects in a largely perpendicular manner from the end wall 12 of the centrifuge drum, directly in front of the associated outlet 14, and at the same time is fastened in a stationary manner.

Figure 7:
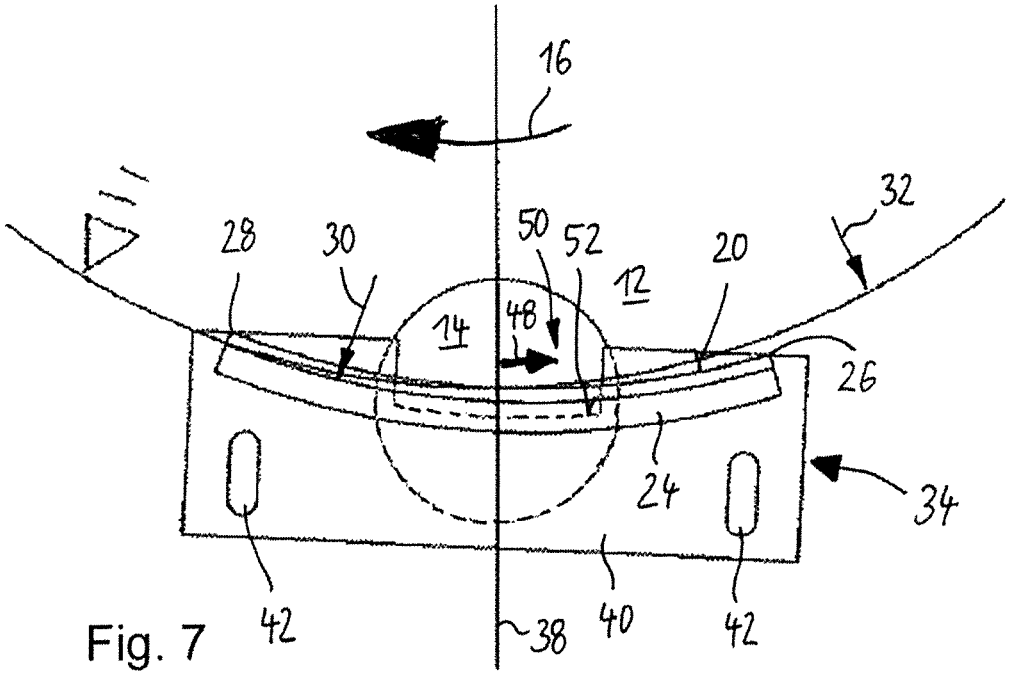
FIG. 7 shows a front view of the energy recovery device from FIG. 5 in a state mounted on a centrifuge drum for a first direction of rotation.

Via the active surface 20, the material flowing out can (see FIG. 7) flow substantially only in a tangential manner and thus somewhat radially toward the outside, starting from the outlet 14. In particular, the radial flow path, starting from the center of the outlet 14, is limited to approximately 8° radially toward the outside, until the material flowing out can finally emerge freely radially toward the outside over a first overflow edge 26 on the right-hand rim of the shell 24 with reference to FIG. 7. The same applies for the second active surface 22 and a second overflow edge 28 with regard to the second direction of rotation 18 (see FIG. 8).

To this end, with regard to the rotation axis of the centrifuge drum, the shell 24 has a radius 30 which corresponds to a radius 32 of the material discharged at the outlet 14, the pond surface as it is known.

Figure 8:
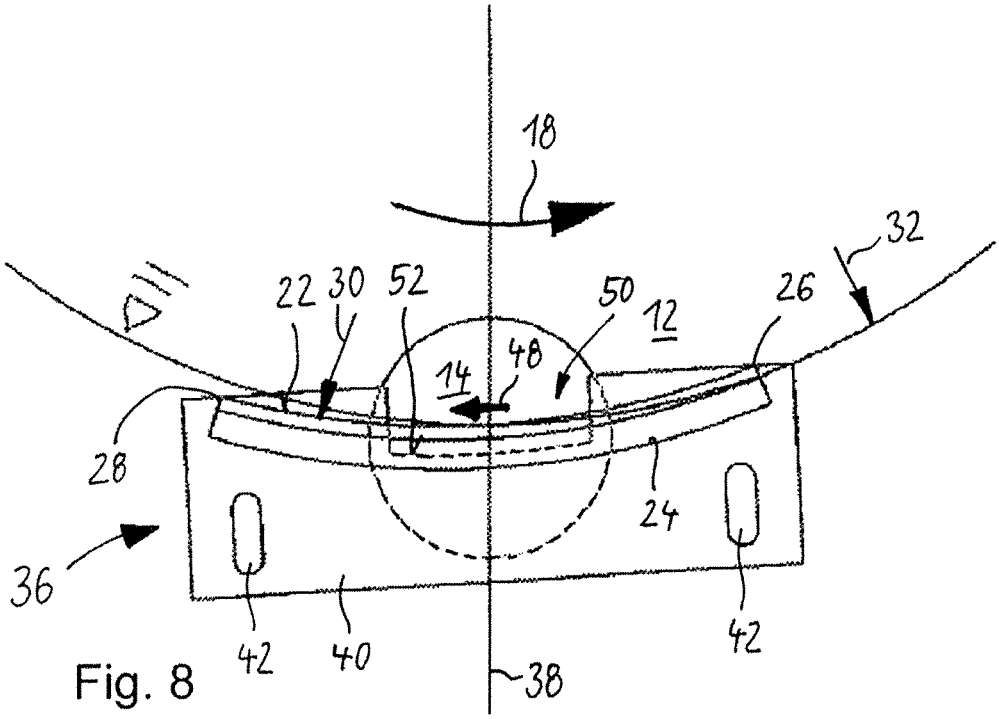
FIG. 8 shows a front view of the energy recovery device from FIG. 5 in a state mounted on a centrifuge drum for a second direction of rotation.

The outflow surface formed in such a way with the shell 24 and the two active surfaces 20 and 22 thereof can to this end be positioned in a simple manner on the end wall 12 in two positions, a first position 34 (FIG. 7) and a second position 36 (FIG. 8).

In the two positions 34 and 36, the shell 24 is in each case in an inclined position at an angle of preferably between +/−2° and +/−20°, particularly preferably +/−10°, with regard to a radial direction 38 of the associated outlet 14. In order to allow this positioning, the shell 24 is supported simply by means of a backplate 40 in which two slots 42 for fastening to the end wall 12 by means of screws (not illustrated) are formed.

Figure 2:
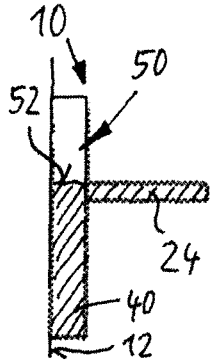
FIG. 2 shows the section II from FIG. 1.
Figure 3:
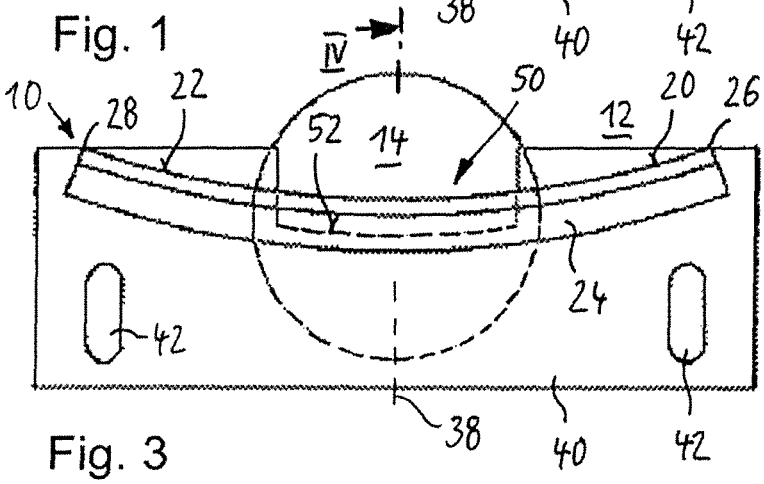
FIG. 3 shows a front view of a second exemplary embodiment of an energy recovery device according to the invention.
Figure 4:
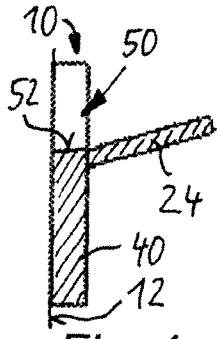
FIG. 4 shows the section IV from FIG. 3.
Figure 5:
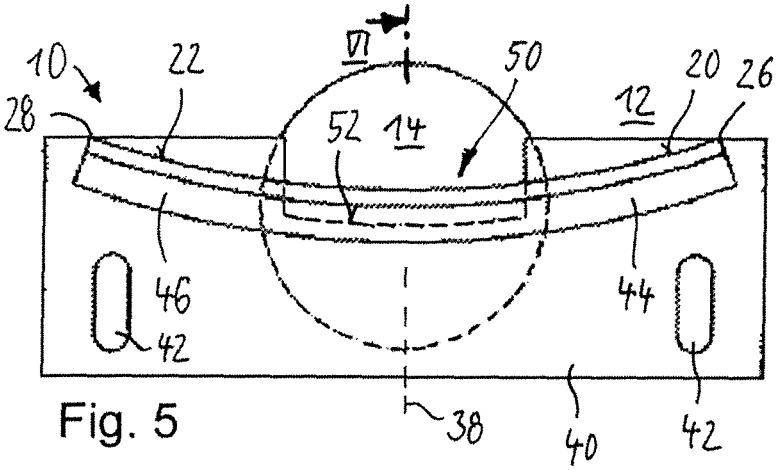
FIG. 5 shows a front view of a third exemplary embodiment of an energy recovery device according to the invention.
Figure 6:
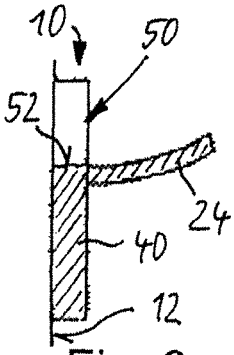
FIG. 6 shows the section VI from FIG. 5.

The shell 24 in FIGS. 1 and 2 is held by means of the backplate 40 so as to project perpendicularly from the end wall 12. In FIGS. 3 to 6, the shell 24 is designed in a manner rising axially toward the outside starting from the outlet 14. In this case, a deflection of the material flowing out into a largely tangential direction of movement 48 with the controlledly radial outward movement explained above is supported at a first deflecting surface 44 and a second deflecting surface 46, depending on the direction of rotation. The shell 24 thus forms a deflecting surface for the clarified material flowing out, said deflecting surface extending in an inclined manner in the longitudinal direction of the centrifuge drum from radially on the outside to radially on the inside. In this case, the shell 24 in FIGS. 3 and 4 is designed in a planar or straight (in particular not curved) manner in the longitudinal section, whereas the shell 24 in FIGS. 5 and 6 also has a curvature in the axial direction.

The material flowing out passes onto the shell 24 at a weir device 50 formed within the backplate 40. The weir device 50 is formed with a weir edge 52 on the backplate 40, which, with the inclined positioning of the backplate 40, is then likewise advantageously in a somewhat inclined position, depending on the direction of rotation.

Finally, it should be noted that all of the features which are mentioned in the application documents and in particular in the dependent claims are also intended, in spite of the formal back-reference made to one or more determined claims, to have protection in their own right individually or in any desired combination.

LIST OF REFERENCE SIGNS

10 Energy recovery device
12 End wall of a centrifuge drum
14 Outlet in the form of an outlet opening
16 First direction of rotation
18 Second direction of rotation
20 First active surface
22 Second active surface
24 Shell
26 First overflow edge
28 Second overflow edge
30 Radius of the shell
32 Radius of the material discharged at the outlet (pond surface)
34 First position
36 Second position
38 Radial direction
40 Backplate
42 Slot
44 First deflecting surface
46 Second deflecting surface
48 Largely tangential direction of movement
50 Weir device
52 Weir edge

The invention claimed is:

1. A solid-bowl screw centrifuge comprising: a centrifuge drum that is selectively rotatable about a longitudinal axis in either of a first direction of rotation (16) and a second direction of rotation (18) that is opposite to the first direction of rotation (16), at least one outlet (14) for discharging clarified material from the centrifuge drum, and an energy recovery device (10), arranged at the outlet (14)the energy recovery device (10) being movable to a first position (34) when the centrifuge drum is rotated in the first direction of rotation (16) and to a second position (36) when the centrifuge drum is rotated in the second direction of rotation (18), the energy recovery device (10) having a first active surface (20) configured to discharge the clarified material to the outlet (14) when the energy recovery device (10) is in the first position (34) and the centrifuge drum is rotated in the first direction of rotation (16), and a second active surface (22) configured to discharge the clarified material to the outlet (14) when the energy recovery device (10) is in the second position (36) and the centrifuge drum is rotated in the second direction of rotation (18), the energy recovery device (10) being inclined at an angle in a range of between +/−2° and +/−20° with respect to a radial direction (38) of the respective outlet (14) when the energy recovery device (10) is in either of the first position (34) and the second position (36).

2. The solid-bowl screw centrifuge of claim 1, wherein the two active surfaces (20, 22) are formed on a single shell (24).

3. The solid-bowl screw centrifuge of claim 2, wherein the centrifuge drum is configured so that the material discharged at the outlet (14) has a specified radius (32) relative to a rotational axis of the centrifuge drum, and the shell (24) is formed with a radius (30) that is the same as the radius (32) of the material discharged at the outlet (14).

4. The solid-bowl screw centrifuge of claim 2, wherein the centrifuge drum is configured so that the material discharged at the outlet (14) has a specified radius (32) relative to a rotational axis of the centrifuge drum, and the shell (24) is formed with a radius that is greater than the radius (32) of the material discharged at the outlet (14).

5. The solid-bowl screw centrifuge of claim 1, wherein the energy recovery device (10) is formed in an area-symmetrical manner.

6. The solid-bowl screw centrifuge of claim 1, wherein the energy recovery device (10) is selectively securable in the first position (34) and in the second position (36).

7. The solid-bowl screw centrifuge of claim 1, wherein the outlet (14) is formed as an outlet opening in a drum end wall (12) of the centrifuge drum, and the energy recovery device (10) is attachable to the drum end wall (12) in a stationary manner in either of the first and second positions (34, 36), and wherein the first and second positions (34, 36) are offset from a radial direction (38) by equal but opposite angular amounts.

8. The solid-bowl screw centrifuge of claim 1, wherein the first active surface (20) of the energy recovery device (10) is inclined relative to the longitudinal axis to define a first deflecting surface (44) by way of which clarified material is deflectable from a largely axial direction of movement into a largely tangential direction of movement (48) when the centrifuge drum is rotated in the first direction of rotation (16), and the second active surface (22) is inclined relative to the longitudinal axis to define a second deflecting surface (46) by way of which clarified material is deflectable from a largely axial direction of movement into a largely tangential direction of movement (48) when the centrifuge drum is rotated in the second direction of rotation (18).

9. The solid-bowl screw centrifuge of claim 8, wherein the two active surfaces (20, 22) and the two deflecting surfaces (44, 46) are formed on a single shell (24).

10. The solid-bowl screw centrifuge of claim 1, further comprising a weir device (50) that is able to be brought into at least two positions together with the energy recovery device (10), and is formed integrally with the energy recovery device (10).

* * * * *